US011044961B1

(12) United States Patent
Craig

(10) Patent No.: US 11,044,961 B1
(45) Date of Patent: Jun. 29, 2021

(54) SAFETY HELMET

(71) Applicant: Jessel Craig, Mansfield, TX (US)

(72) Inventor: Jessel Craig, Mansfield, TX (US)

( * ) Notice: Subject to any disclaimer, the term of this patent is extended or adjusted under 35 U.S.C. 154(b) by 163 days.

(21) Appl. No.: 16/597,158

(22) Filed: Oct. 9, 2019

(51) Int. Cl.
*A42B 3/30* (2006.01)
*A42B 3/04* (2006.01)

(52) U.S. Cl.
CPC ..... *A42B 3/046* (2013.01)

(58) Field of Classification Search
CPC ..... H04R 2460/13; H04R 1/028; H04R 3/00; H04R 1/20; H04R 2460/07; H04R 25/505; H04R 2201/023; G06F 1/163; G06F 3/167; G06F 3/011; G06F 3/0304; A63B 2220/40; A63B 2220/833; A63B 2225/20; A63B 2225/50; A42B 3/046
See application file for complete search history.

(56) References Cited

U.S. PATENT DOCUMENTS 8,686,843 B2 * 4/2014 Schiebahn ..... B60Q 9/004 340/436
8,989,417 B1 * 3/2015 Zhong ..... H04R 5/033 381/326
9,264,803 B1 * 2/2016 Johnson ..... G01S 15/04
9,727,790 B1 * 8/2017 Vaziri ..... G06F 3/012
9,947,215 B2 * 4/2018 Di Censo ..... G08G 1/005
10,222,617 B2 * 3/2019 Jannard ..... G02C 11/10
10,659,868 B1 * 5/2020 Xu ..... G02C 11/06
10,783,904 B2 * 9/2020 Bouserhal ..... H04R 3/005
10,924,712 B2 * 2/2021 Ross ..... A61B 90/35
2003/0174305 A1 * 9/2003 Kasper ..... G01S 11/12 356/3.09
2010/0149073 A1 * 6/2010 Chaum ..... G02B 27/0172 345/8
2012/0081219 A1 * 4/2012 Schiebahn ..... G08G 1/168 340/435
2013/0070935 A1 * 3/2013 Hui ..... G10L 21/0208 381/71.1
2013/0293448 A1 * 11/2013 Jannard ..... G02C 11/06 345/8
2016/0093207 A1 * 3/2016 Di Censo ..... H04R 1/1091 340/944
2016/0217781 A1 * 7/2016 Zhong ..... H04R 1/10
2017/0160394 A1 * 6/2017 Johnson ..... G06F 1/163
2018/0154242 A1 * 6/2018 Austin ..... A63B 71/085
2019/0214038 A1 * 7/2019 Bouserhal ..... H04R 3/005
(Continued)

*Primary Examiner* — Robert H Muromoto, Jr.
(74) *Attorney, Agent, or Firm* — Gulf Coast Intellectual Property Group

(57) ABSTRACT

A safety helmet configured to provide notification to a wearer of a potential safety hazard wherein the notification is transmitted via bone conduction and is directionally aligned with the heading of the potential hazard. The safety helmet of the present invention includes a body wherein the body has disposed thereon a plurality of location sensors. The location sensors transmit signals so as to identify potential hazards in the area proximate the user. The location sensors are secured to the safety helmet using brackets wherein the sensor brackets have a first mode and a second mode. The bone conduction transmitters are operable to ensure transmission of a warning sound to a user in noisy environments. An elevation sensor is configured to monitor the height of the wearer respective to a calibrated ground.

18 Claims, 2 Drawing Sheets

(56) References Cited

U.S. PATENT DOCUMENTS

| | | | | |
|---|---|---|---|---|
| 2019/0385342 | A1* | 12/2019 | Freeman | A61B 3/113 |
| 2020/0296521 | A1* | 9/2020 | Wexler | G06K 9/00248 |
| 2020/0358987 | A1* | 11/2020 | Ross | A61B 5/0022 |
| 2021/0105074 | A1* | 4/2021 | McRae | G02C 11/10 |
| 2021/0105554 | A1* | 4/2021 | McRae | G02C 11/10 |

* cited by examiner

SAFETY HELMET

FIELD OF THE INVENTION

The present invention relates generally to safety equipment, more specifically but not by way of limitation, a safety helmet wherein the safety helmet is configured to provide notifications to a user of potential hazards and further is configured with additional safety elements.

BACKGROUND

Protective headgear as we know it takes a reactive, after-the-fact or after-the-incident approach to managing the safety of users. Hard hats and other protective headgear protect the user after contact with the safety hazard, as opposed to preventing contact with the safety hazard. The design and use of protective headgear as Personal Protective Equipment, has not adequately evolved to address the increased complexity of our jobsites as users are required to navigate more complex environments, with more equipment, employees, and in general, more potential safety hazards. Safety head gear, for example, hard hats, also limit protection of the wearer to just the head as opposed the full body protection against environmental hazards, including but not limited to, fall hazards and being struck by objects.

Accordingly, there is a need for protective/safety headgear that employs proactive embodiment wherein the embodiment monitors the jobsite environment and effectively alerts the wearer of potential hazards, establishing a safety zone, perimeter, or shield around the wearer that isn't limited to the head but to the entire body.

SUMMARY OF THE INVENTION

It is the object of the present invention to provide a safety helmet that is configured to provide protection for a wearer and further provide directional location of potential hazards wherein the present invention includes a plurality of location transceivers.

Another object of the present invention is to provide a safety helmet that is configured to provide notification to a wearer of a potential hazard and the location thereof with respect to the wearer wherein the plurality of location transceivers are positioned on the safety helmet to ensure monitoring of a desired area or perimeter proximate to a user.

A further object of the present invention is to provide a safety helmet that is configured to provide protection for a wearer and further provide directional location of potential hazards wherein the present invention wherein the location transceivers are operably coupled to bone conduction transmitters.

Still another object of the present invention is to provide a safety helmet that is configured to provide notification to a wearer of a potential hazard and the location thereof with respect to the wearer wherein the bone conduction transmitters are mounted internally within the head cavity of the safety helmet.

An additional object of the present invention is to provide a safety helmet that is configured to provide protection for a wearer and further provide directional location of potential hazards wherein the present invention wherein the location transceivers are secured utilizing mounting brackets operable to ensure the maintenance of the position of the transceiver despite the position of the head of the wearer of the present invention.

Yet a further object of the present invention is to provide a safety helmet that is configured to provide notification to a wearer of a potential hazard and the location thereof with respect to the wearer wherein the bone conduction transmitters are activated so as to be directionally specific.

Another object of the present invention is to provide a safety helmet that is configured to provide protection for a wearer and further provide directional location of potential hazards wherein the safety helmet further employs sound emitting sensors to provide monitoring of the area proximate the wearer of the safety helmet.

Still an additional object of the present invention is a safety helmet that is configured to provide notification to a wearer of a potential hazard and the location thereof with respect to the wearer wherein the safety helmet further monitors the elevation of the wearer.

Still a further object of the present invention is to provide a safety helmet that is configured to provide notification to a wearer of multiple potential hazards concurrently and the location thereof with respect to the wearer.

Yet an additional object of the present invention is to provide a safety helmet that is configured to provide notification to a wearer of a potential hazard and the location thereof with respect to the wearer wherein the safety helmet further monitors changes in terrain, ground conditions, and floors conditions.

Still another object of the present invention is to provide a safety helmet that is configured to provide notification to a wearer of a potential hazard and the location thereof with respect to the wearer wherein the safety helmet further monitors the speed and distance of approaching objects.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
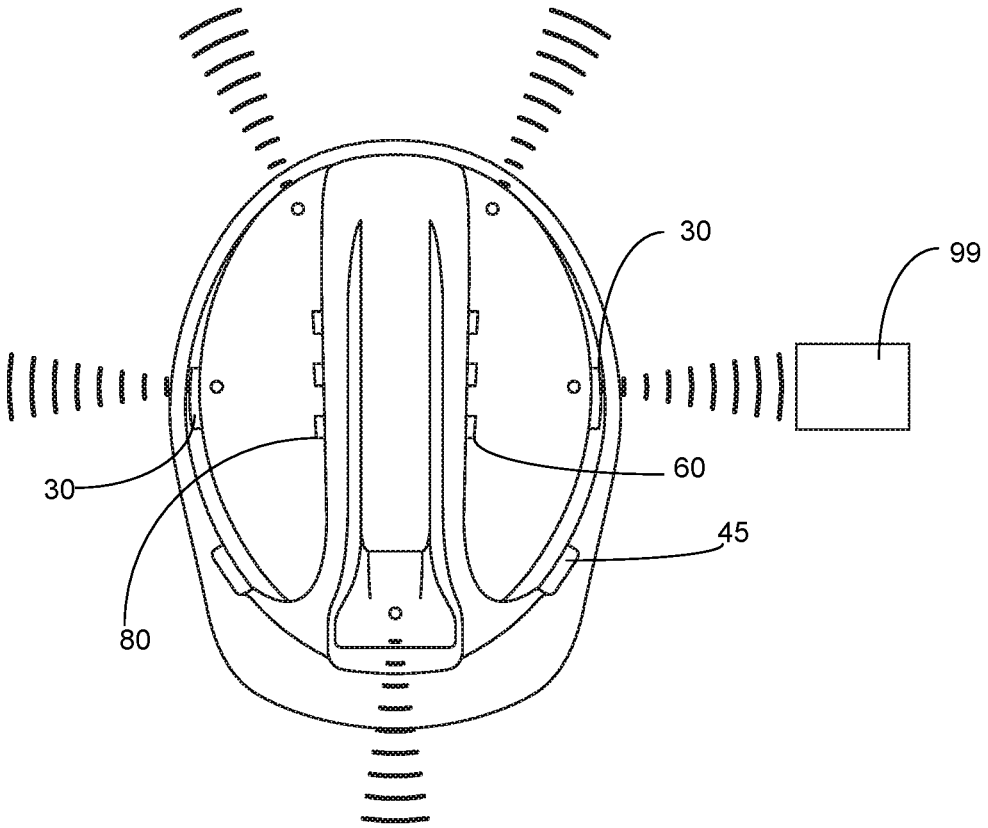
FIG. 1 is a top view of an embodiment of the present invention.
Figure 2:
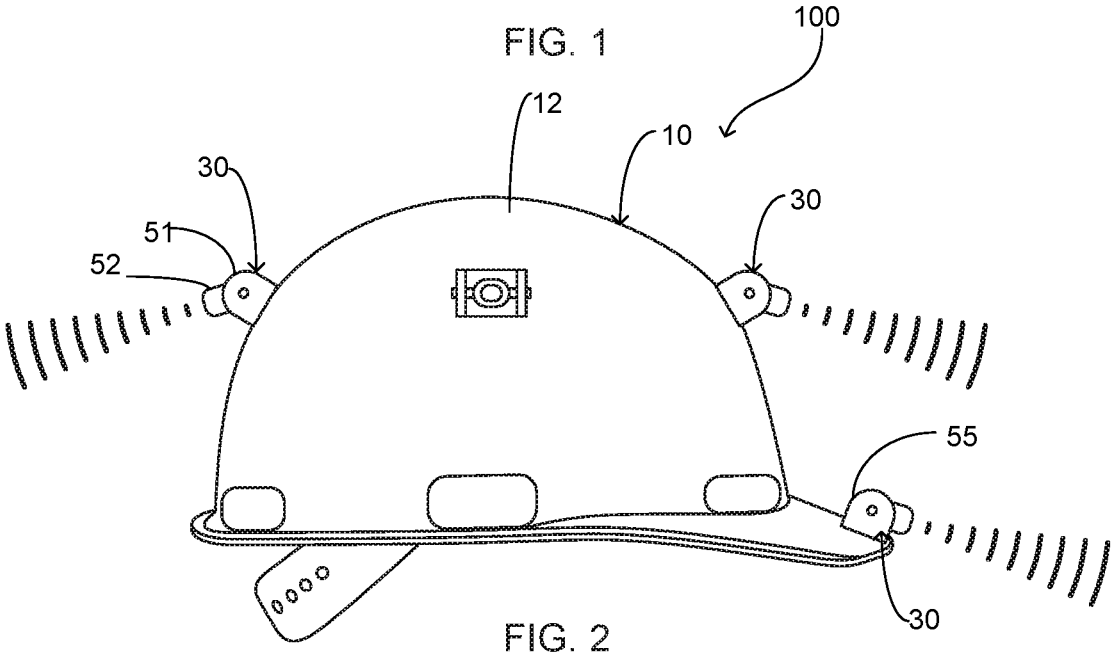
FIG. 2 is side view of an embodiment of the present invention.

Referring now to the drawings submitted herewith, wherein various elements depicted therein are not necessarily drawn to scale and wherein through the views and figures like elements are referenced with identical reference numerals, there is illustrated a safety helmet 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted as a part hereof the safety helmet 100 further includes a body 10 having a dome portion 12 wherein the dome portion 12 includes a cavity 14. The cavity 14 is of suitable size so as to accommodate a portion of a human head therein. The cavity 14 further has operably disposed therein the securing elements 15 that are configured to releasably secure the body 10 to a head of a wearer. It should be understood within the scope of the present invention that the safety helmet 100 could employ various alternate securing elements 15 in order to provide the ability to secure the safety helmet 100 to the head of a user. Furthermore, while the embodiment of the safety helmet 100 illustrated herein is representative of a conventional hardhat, it is contemplated within the scope of the present invention that the safety helmet 100 could be provided in numerous alternate embodiments such as but not limited to a police helmet or military helmet.

Providing operational control of the elements of the safety helmet 100 discussed in the ensuing is the central processing unit 20. The central processing unit 20 includes the necessary electronics to receive, store, transmit and manipulate data. The central processing unit 20 provides the operation of the features of the elements of the safety helmet 100 and includes a conventional power source such as but not limited to a battery. The central processing unit 20 processes the sound waves and data received by the location sensors 30 and transmits the data via the bone conduction transmitters 40 to the wearer. In some applications, the safety helmet 100 can be used as a standalone device, and in other applications it is further coupled to a remote server and/or portable computing device wherein the central processing unit 20 provides transfer of data received to the aforementioned for processing and collection. It should be understood within the scope of the present invention that the central processing unit 20 utilizes conventional wireless communication protocols to communicate with the aforementioned remote devices. It is further contemplated within the scope of the present invention that the central processing unit 20 includes a pressure switch or similar element that is operable to provide activation of the safety helmet 100 subsequent being placed on the head of the user. The central processing unit 20 further includes the necessary electronics to communicably couple with a portable computing device such as but not limited to a smart phone.

Disposed on the exterior of the body 10 are a plurality of location sensors 30. The location sensors 30 are mounted on the body 10 so as to ensure coverage of a desired area or perimeter surrounding the wearer. In the preferred embodiment, the location sensors 30 are ultrasonic transceivers that are configured to convert ultrasound signals into data and provide interpretation of reflected sound waves in order to identify an object and the distance thereto. The location sensors 30 are operable to provide mapping of the local environment surrounding the safety helmet 100 so as to provide information to a wearer thereof of potential hazards. By way of example but not limitation, an exemplary object 99 is illustrated herein in FIG. 1. The exemplary object 99 could represent any potential hazard to a wearer of the safety helmet 100 in various environments. The location sensors 30 are operable to identify the exemplary object 99 and further determine the distance thereto in order to ascertain the potential as a safety hazard based on the position of the wearer of the safety helmet 100 with respect to the location of the exemplary object 99. More specifically but not by way of limitation, if the location sensor 30 determines that the exemplary object 99 presents a safety hazard as the exemplary object 99 is moving towards the user or vice versa, the safety helmet 100 will transmit a warning signal to a wearer as is further discussed herein. It is contemplated within the scope of the present invention that the location sensors 30 could employ alternate technology to provide the aforementioned. More specifically but not by way of limitation the location sensors 30 could utilize various technologies including but not limited to sonar, radar or light. It should be further understood within the scope of the present invention that as few as one location sensor 30 could be secured to the body 10 or a multitude as needed for a desired application.

Disposed within the cavity 14 of the safety helmet 100 are a plurality of bone conduction transmitters 40. As is known in the art, bone conduction is the conduction of sound to the inner ear primarily through the bones of the skull. Bone conduction transmission occurs as sound waves vibrate bone in the skull. The bone conduction transmitters 40 are operably coupled to the location sensors 30 via the central processing unit 20. The safety helmet 100 is configured to be worn in various environments wherein the ambient noise level in the environments may prevent successful transmission of conventional audio sound. As such, the safety helmet 100 is configured with bone conduction transmitters 40 operable to transmit sound such as but not limited to a warning signal to a user. The bone conduction transmitters 40 are configured to be directionally oriented in order to assist a user with the directional location of a specific hazard as related to the user. By way of example but not limitation, when a location sensor 30 determines an exemplary object 99 presents a hazard to a user, the location sensor 30 transmits a signal to the central processing unit 20 wherein the central processing unit 20 activates the bone conduction transmitter 40 directionally aligned with the potential hazard. For example, if an exemplary object 99 is to the left of the user, at least one bone conduction transmitter 40 on the left side of the cavity 14 will be activated so as to alert the user and provide an audio alarm that indicates the directional location of the potential hazard. The location sensors 30 monitor objects in the environment and transmit data to the central processing unit for processing. The monitoring data transmitted to the central processing unit 20 includes but is not limited to the distance of objects in proximity to the wearer, the speed of objects, the density of objects, the elevation of the wearer, height information and dimensional information of the surroundings.

The bone conduction transmitters 40 are operably coupled to the location sensors 30 via the central processing unit 20. The safety helmet 100 is configured to be worn in various environments wherein the ambient noise level in the environments may prevent successful transmission of conventional audio sound. As such, the safety helmet 100 is configured with bone conduction transmitters 40 operable to transmit sound such as but not limited to a warning signal to a user. The bone conduction transmitters 40 are strategically placed to make contact with the wearer's cranium and around the ear cavities so as to provide the direction of the sound and be able to transmit a signal to a wearer allowing the wearer to ascertain the direction of the hazard.

Figure 3:
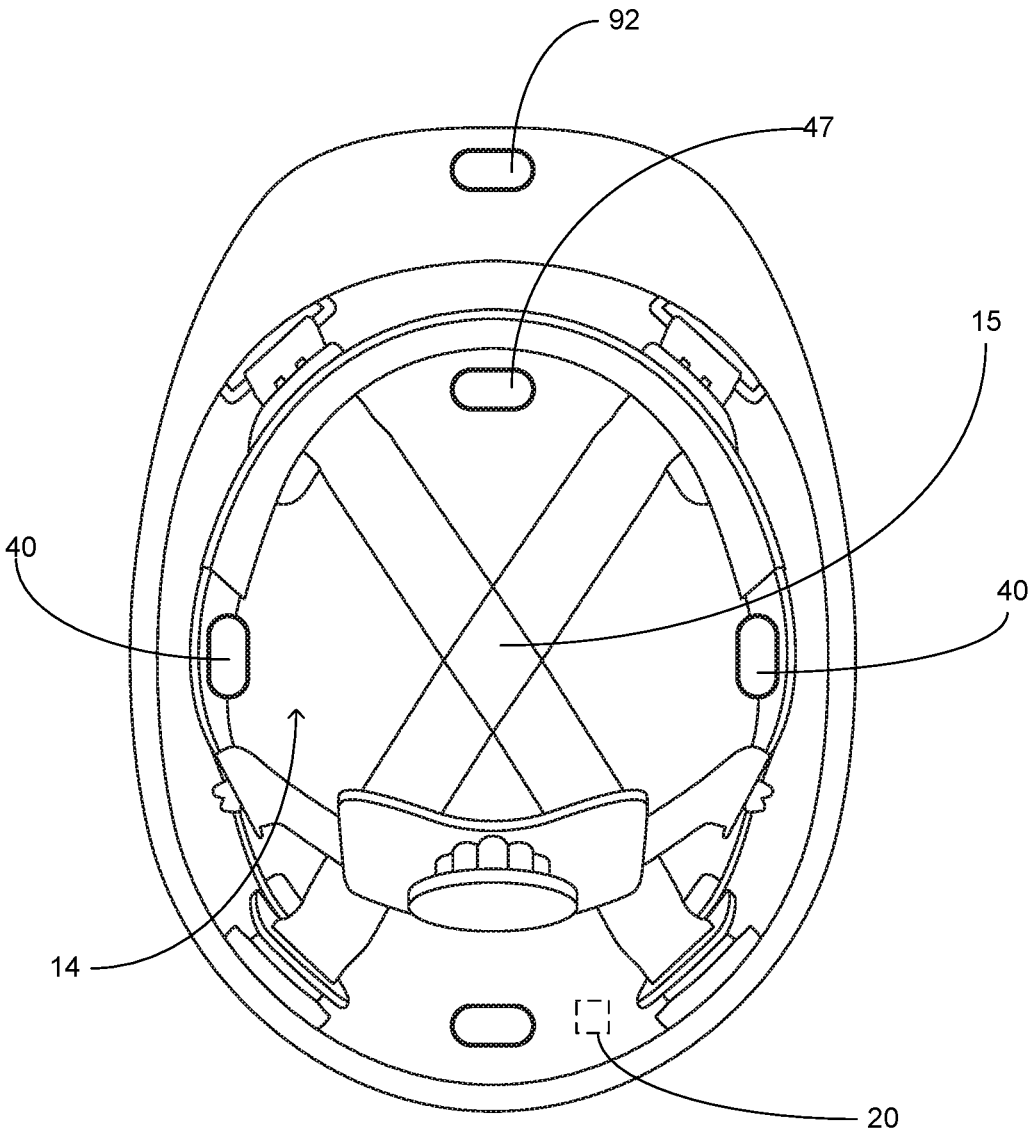
FIG. 3 is an internal view of the head cavity of the present invention.

It is contemplated within the scope of the present invention that the safety helmet 100 could employ various quantities of bone conduction transmitters 40 but there are at least four as illustrated herein in FIG. 3 so as to provide the directional correlation of a potential hazard. At least one of the location sensors 30 is configured as an elevation sensor 92 and is strategically placed to monitor the distance of the wearer's head to the ground or floor surface. The central processing unit 20 is programmed to monitor if this distance is changes, if the wearer distance is outside of the programmed tolerances, the wearer is notified of the potential safety hazard and precautions to be adhered to via the bone conduction transmitters 40. By way of example but not limitation, the elevation sensor 92 may be set to transmit a signal at any distance greater than seven feet from the safety helmet 100 to the floor. If a wearer is six feet tall, as he or she ascends up a ladder and the distance between the safety helmet 100 and the ground exceeds seven feet, the wearer is notified of the potential dangers. The elevation monitoring will stop as soon as the wearer returns to the preprogrammed elevation based on the programmed tolerances established by the central processing unit 20. It should be understood within the scope of the present invention that the warning signal could vary in frequency and duration. The location sensors 30 also monitor the changes in ground or floor conditions to determine if a fall hazard exists. The central processing unit 20 is programmed to activate a hazard notification to the wearer if changes in the floor exceed programmed tolerances. By way of example but not limitation, if the programmable limit is twelve inches, and the wearer is approaching an open elevator shaft that creates an opening in the floor of over twelve inches the safety helmet 100 will notify the wearer of the hazard and its location with respect to the position of the wearer.

The location sensors 30 are secured to the body 10 utilizing adjustable mounts or brackets 50. The brackets 50 can be configured in two modes, in the first mode the wearer can manually adjust the angle of the location sensor 30 to their preferred field of monitoring. Adjusting the location sensor 30 to an orientation or angle further away from the wearer, resulting in monitoring of an larger perimeter/area around the user. In the first mode the safety helmet 100 is monitoring a portion of the environment that is further away from the wearer as the location sensor 30 is adjusted to a further angle. This configuration is useful in more open environments where there are fast moving objects and the wearer needs to be alerted further in advance. By way of example but not limitation if a wearer is working on the side of a highway where vehicles may be approaching at faster speeds. The brackets 50 in their second mode are adjusted to an angle so as to reduce the scope of monitoring to a closer perimeter/area around the user. This second mode of configuration is useful in more confined environments where there are slower moving objects and the wearer needs to be alerted on closer hazards as opposed to those located distal to the wearer. By way of example but not limitation a wearer performing demolition work on the interior of a building may be more concerned with falling and moving objects within closer proximity to the wearer. The adjustable bracket 50 further allows the wearer to adjust the location sensors 30 for unique circumstances such as environments that may be prone to mainly over-head hazards. The wearer can adjust the location sensors 30 to face upward to monitor the above-head environment. By way of example but not limitation a wearer in a dark underground mine where wearers are concerned with head injuries from contact with the protruding masses of the mine or falling rocks. It should be noted that the adjustments of the location sensors 30 can be executed by adjusting a single location sensor 30 or more than one location sensor 30. In the second mode the bracket 50 is set to a pre-established angle to monitor a perimeter or area around the wearer that those in the art would deem reasonable for the typical user. It is contemplated within the scope of the present invention that the safety helmet 100 may consist of one or more of the adjustable and/or pre-set brackets 50 or a combination thereof. The brackets 50 are secured to the location sensor 30 so as to provide pivotal support of the location sensor 30 allowing the movement of the safety helmet 100 around a singular or plural axis of the location sensor 30 in its established orientation/angle ensuring that as the safety helmet 100 moves the location sensors 30 maintain the desired orientation or angle. The pivotal support includes but is not limited to gimbals or ball brackets and can be electronically or mechanically controlled. The brackets 50 pivoting support is configured to maintain a level orientation so as to provide continual monitoring of the area proximate the wearer of the safety helmet 100 irrespective of the movement of the wearer's head.

One or more impact sensors 80 are coupled with the central processing unit 20. In the event of a collision to the body or head of the wearer, the impact sensors 80 measures the impact and if the impact is outside of the programmed tolerances of the central processing unit 20 the beacon transmitter 60 is activated to transmit a distress signal by transmitting a unique pattern of sound waves or other suitable alarm. The distress signal can be identified by other similar devices and using the directional bone conductor transmitters 40 wherein alternate safety helmets 100 are networked utilizing suitable wireless protocols. Networking of additional safety helmets 100 provides the ability to direct other wearers of the safety helmet 100 to the general proximity of the distress signal. The foregoing is an exemplary situational matter and it should be understood within the scope of the present invention that the impact sensors 80 could provide signals to the central processing unit 20 in alternate conditions. The central processing unit 20 can be configured to communicate with portable devices via wireless frequencies, including but not limited to, Bluetooth and WiFi. In the event that collision or high impact is detected, the safety helmet 100 can communicate with the portable computing devices to perform a number of emergency operations, including but not limited to calling emergency personnel for help and further providing geo-location information.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A safety helmet configured to alert a wearer of a potential hazard in an area proximate thereto comprising:

a body, said body having a cavity configured to receive a portion of a human head therein, said body having an exterior surface, said exterior surface configured to provide protection for a wearer of the safety helmet;

a central processing unit, said central processing unit configured to receive, store, transmit and manipulate data, said central processing unit operable to provide operation of the safety helmet;

at least one location sensor, said at least one location sensor being secured to the exterior surface of said body, said location sensor configured to provide monitoring of a portion of an area surrounding the wearer of the safety helmet, said at least one location sensor operably coupled to said central processing unit;

at least one bone conduction transmitter, said at least one bone conduction transmitter being disposed in said cavity, said at least one bone conduction transmitter being operably coupled to said at least one location sensor; and wherein said at least one bone conduction transmitter is configured to transmit a warning signal of a location of a potential hazard proximate a wearer wherein the warning signal is directionally aligned with the location of the potential hazard; and wherein said at least one location sensor is secured to said body utilizing a bracket, said bracket having a first position and a second position.

2. The safety helmet as recited in claim 1, wherein in said first position said bracket is configured to position the at least one location sensor to monitor an area distal to a wearer of the safety helmet.

3. The safety helmet as recited in claim 2, wherein in said second position said bracket is configured to position the at least one location sensor to monitor an area proximate to a wearer of the safety helmet.

4. The safety helmet as recited in claim 3, and further including a beacon transmitter, said beacon transmitter operably coupled to said central processing unit, said beacon transmitter configured to emit an emergency signal.

5. The safety helmet as recited in claim 4, and further including an elevation sensor, said elevation sensor configured to monitor the position of the wearer relative to a calibrated ground floor.

6. The safety helmet as recited in claim 5, and further including an accelerometer, said accelerometer being operably coupled to said central processing unit, said accelerometer configured to transmit a signal to the central processing unit upon detection of an impact with an object that exceeds a programmed tolerance.

7. A safety helmet configured to alert a wearer of a potential hazard in an area proximate and further provide the directional location of the potential hazard wherein the safety helmet comprises:

a body, said body having a cavity configured to receive a portion of a human head therein, said body having an exterior surface, said exterior surface configured to provide protection for a wearer of the safety helmet;

a central processing unit, said central processing unit configured to receive, store, transmit and manipulate data, said central processing unit operable to provide operation of the safety helmet;

a plurality of location sensors, said plurality of location sensors being secured to the exterior surface of said body, said plurality of location sensors mounted to said body so as to circumferentially monitor the area proximate the safety helmet, said plurality of location sensors operably coupled to said central processing unit, wherein plurality of location sensors are secured to a plurality of brackets;

a plurality of bone conduction transmitters, said plurality of bone conduction transmitters being disposed in said cavity, said plurality of bone conduction transmitters being circumferentially located within the cavity, said plurality of bone conduction transmitters being operably coupled to said central processing unit and said plurality of location sensors;

wherein said the plurality of bone conduction transmitters are configured to transmit a warning signal of a location of a potential hazard proximate a wearer wherein the warning signal is emitted from one of the plurality of bone conduction transmitters that is directionally aligned with the potential hazard; and wherein said plurality of location sensors are secured to said body utilizing brackets, said brackets having a first position and a second position.

8. The safety helmet as recited in claim 7, wherein in the first position said bracket is configured to provide monitoring of an area distal to the wearer.

9. The safety helmet as recited in claim 8, wherein in said second position said bracket is configured to position the at least one location sensor to monitor an area proximate to a wearer of the safety helmet.

10. The safety helmet as recited in claim 9, and further including at least one impact sensor, said at least one impact sensor being operably coupled to said central processing unit, said at least one impact sensor configured to transmit a signal to the central processing unit upon detection of an impact with an object that exceeds a programmed tolerance.

11. The safety helmet as recited in claim 10, and further including an elevation sensor, said elevation sensor configured to monitor the position of the wearer relative to a calibrated ground floor.

12. The safety helmet as recited in claim 11, wherein said plurality of location sensors are ultrasonic sensors.

13. A safety helmet configured to alert a wearer of a potential hazard in an area proximate and further provide the directional location of the potential hazard wherein the safety helmet comprises:

a body, said body having a cavity configured to receive a portion of a human head therein, said body having an exterior surface, said exterior surface configured to provide protection for a human head disposed in said cavity of said body;

a central processing unit, said central processing unit configured to receive, store, transmit and manipulate data, said central processing unit operable to provide operation of the safety helmet;

a plurality of location sensors, said plurality of location sensors being secured to the exterior surface of said body, said plurality of location sensors being positioned around a circumferential edge of said body so as to be mounted completely therearound, said plurality of sensors configured to emit a signal so as to provide monitoring of an area adjacent to and surrounding the wearer, said plurality of location sensors operably coupled to said central processing unit, wherein plurality of location sensors are secured to a plurality of brackets, said plurality of brackets having a first position and a second position;

a plurality of bone conduction transmitters, said plurality of bone conduction transmitters being disposed in said cavity, said plurality of bone conduction transmitters being circumferentially located within the cavity, said plurality of bone conduction transmitters being operably coupled to said central processing unit and said plurality of location sensors, said plurality of bone conduction transmitters configured to transmit a warning sound to the wearer wherein the warning sound is emitted from one of said plurality of bone conduction transmitters that is directionally aligned with a potential hazard; and wherein in said first mode of said plurality of brackets said location sensors are operable to monitor an area distal to the wearer.

14. The safety helmet as recited in claim 13, and further including at least one impact sensor, said at least one impact sensor being operably coupled to said central processing unit, said at least one impact sensor configured to transmit a signal to the central processing unit upon detection of an impact with an object that exceeds a programmed tolerance.

15. The safety helmet as recited in claim 14, wherein in said second position of said plurality of brackets said location sensors are operable to monitor an area proximate the wearer.

16. The safety helmet as recited in claim 15, and further including a beacon transmitter, said beacon transmitter operably coupled to said accelerometer, said beacon transmitter activated by said accelerometer.

17. The safety helmet as recited in claim 16, and further including an elevation sensor, said elevation sensor configured to monitor the position of the wearer relative to a calibrated ground floor.

18. The safety helmet as recited in claim 17, wherein said plurality of location sensors are ultrasonic sensors.

* * * * *